United States Patent [19]

Tschanz

[11] 4,347,594

[45] Aug. 31, 1982

[54] WORLD WATCH

[76] Inventor: Pierre Tschanz, Neuwis 25, Küsnacht, Switzerland

[21] Appl. No.: 192,522

[22] PCT Filed: May 22, 1979

[86] PCT No.: PCT/CH79/00073

§ 371 Date: Jan. 23, 1980

§ 102(e) Date: Jan. 7, 1980

[87] PCT Pub. No.: WO79/01104

PCT Pub. Date: Dec. 13, 1979

[30] Foreign Application Priority Data

May 23, 1978 [CH] Switzerland ..... 5618/78

[51] Int. Cl.[3] ..... G04B 19/22

[52] U.S. Cl. ..... 368/21; 368/27

[58] Field of Search ..... 368/21, 27, 22, 76, 368/80, 26

[56] References Cited

U.S. PATENT DOCUMENTS 3,277,646 10/1966 Howard, Sr.
3,382,666 5/1968 Gerry .

FOREIGN PATENT DOCUMENTS 2326729 4/1977 France .
201344 2/1939 Switzerland ..... 368/21
339128 7/1959 Switzerland .
343917 2/1960 Switzerland .
451827 5/1968 Switzerland .
1758568 6/1970 Switzerland .
504033 4/1971 Switzerland .

*Primary Examiner*—Bernard Roskoski
*Attorney, Agent, or Firm*—Weingarten, Schurgin & Gagnebin

[57] ABSTRACT

World watch with a single hand (9) comprising a watch mechanism in a case, a bezel (2) above the case, a face (3) and a hand (9), together with a back, said assembly forming an internal body which is mounted in a relatively easy manner within an external locking ring (6). The said ring is located in a peripheral groove (12) formed by the bezel (2) and the back. The body can be rotated in a stepwise manner, as it is locked in each position by means of a locking device comprising two bosses (13) on the locking ring (6) and slots (14) on the bezel (2). One of the attachments (7) carries a numeral (16) and the bezel (2) is provided with a mark (17). By rotating the body, the mark moves away from the stationary numeral. The difference, determined in hours on face (3) which carries no numbers, gives the time variation between different time zones throughout the world.

4 Claims, 5 Drawing Figures

WORLD WATCH

Figure 1:
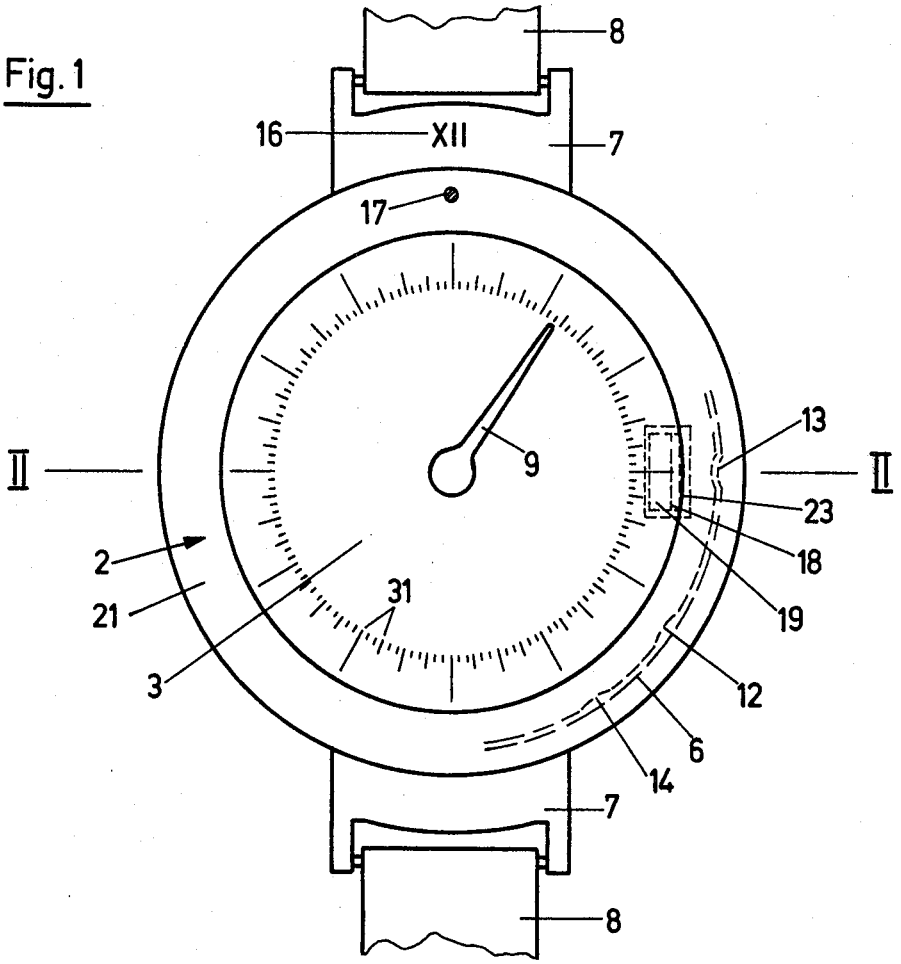

The invention relates to a world watch, that is to say a watch which is able to indicate to the wearer the time at any point in the world on the basis of the local time or which makes it possible to determine the local time at a given place which corresponds to a particularlocal time.

So-called world watches are already known, but their disadvantage is that they are of a relatively complicated construction so as to be able to give the desired information. Furthermore, this information can only be obtained by selecting from a large number of different parts of the watch the particular part necessary for carrying out the requisite setting, which gives rise to incorrect operations and/or interpretations.

One of these watches (Swiss Pat. No. 339,128) has a fixed case comprisng the watch mechanism with two normal hands and a normal face, the latter being surrounded by two rotary rings, whereof one which is called the time zone ring carries the inscriptions indicating the most important city for each time zone, whilst the other ring called the hour ring carries 24 circles corresponding to the 24 hours of the day. As stated hereinbefore, these two rings rotate and can be actuated independently of one another in order to determine the local time in a random place in the world or the local time for a particular time determined in a given place. These two rings necessitate a relatively complicated case construction due to the sealing problems which occur.

Another watch (Swiss Pat. No. 343,917) similar to that described hereinbefore has a rotary time zone ring which can be rotated by the ring flange and is located in an annular groove. It is therefore necessary to provide a special support in the case to receive this ring, as well as to provide a special axial position for the ring flange in order that it can not only drive the watch movement and the hands, but also said ring, without actuating the other parts of the watch during its rotation.

Another world watch (Swiss Pat. No. 451,827) is known which is equipped with four hands. A rotary lunette can be rotated to determine the local time at the given place. However, the presence of four hands not only gives rise to confusion with regard to the local time, but it also significantly complicates the problems of said hands in the centre of the face, together with the individual driving thereof.

Another watch (Swiss Pat. No. 504,033), whose construction is similar to the second of the prior art watches is equipped with a world time indicator in the form of a rotary transparent dome. In the same way there are problems in driving the dome and maintaining the necessary sealing in this construction.

The present invention relates to a world watch which has a much more simplified and robust construction, which can be manufactured at a lower cost and which gives a clear indication of the desired time without giving rise to errors, thus obviating all the disadvantages mentioned hereinbefore.

The world watch according to the invention is characterised by the characterising features of claim 1.

An exemplified embodiment is described in non-limitative manner hereinafter with reference to the drawings, wherein show:

FIG. 1 a front view of the watch.

Figure 2:
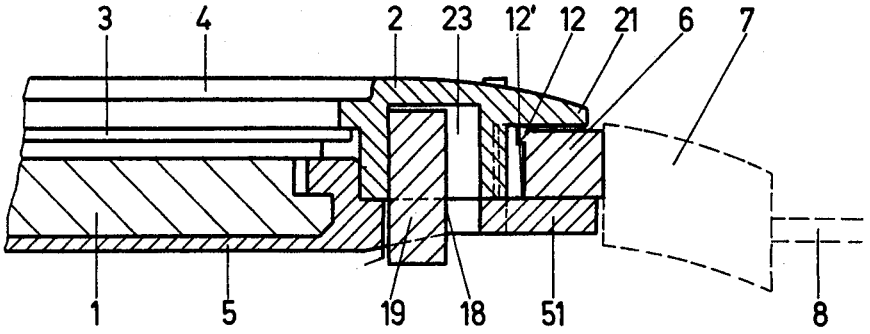

FIG. 2 a partial section along the line II—II of FIG. 1.

Figure 3:
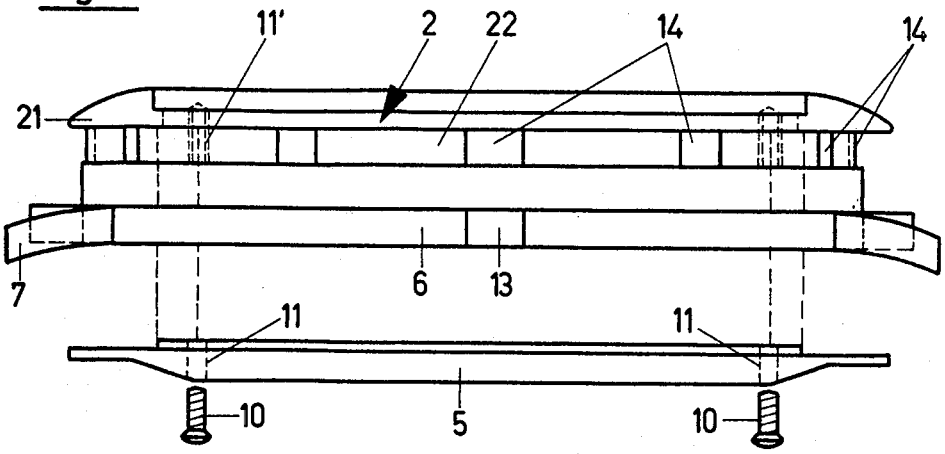

FIG. 3 a side view similar to the cross-section of FIG. 2 of the external parts of the watch in an exploded position.

Figure 4:
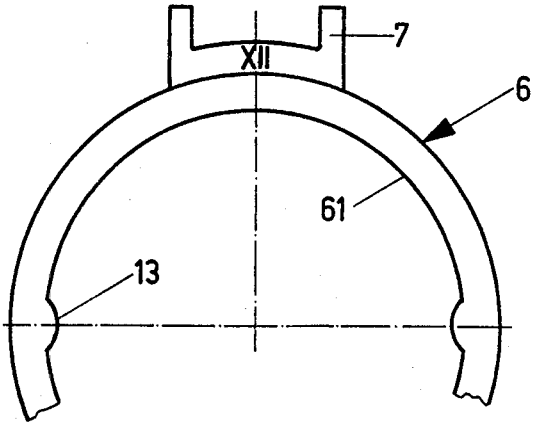

FIG. 4 a partial view of the locking ring.

Figure 5:
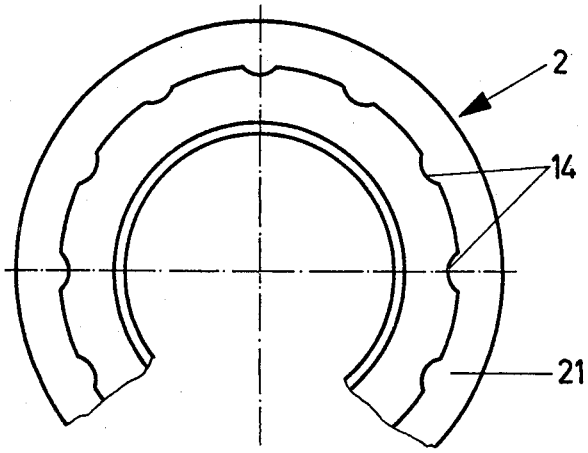

FIG. 5 a partial view from below of the lunette.

The watch comprises a conventional watch mechanism housed in a case (for reasons of simplification the known mechanism and the case are illustrated in FIG. 2 as unit 1), a bezel 2 encircling the face 3 and the glass 4 of the watch above the face 3, a back 5 and a locking ring 6, the latter carrying two diametrically opposite attachments 7 for the strap 8.

The watch mechanism can be of any per se construction but only drives a single hand, i.e. that indicating the hours.

As can be gathered more particularly from FIG. 3 the back 5 and the bezel 2 are fixed by means of screws 10 (preferably four) which are inserted through bores 11 in back 5 and are screwed into corresponding bores 11' in bezel 2. The latter and the back 5 are thus joined together and surround between them the not shown case in order to form a single body located in a rotary manner (to be described hereinafter) in the locking ring 6 which is fixed to the attachment 7 fixed to the strap 8.

Bezel 2 and back 5 are both provided with peripheral zones 21, 51 respectively which, in the fitted state, form a peripheral annular groove 12 whose bottom 12' has a diameter which is slightly smaller than the internal diameter of the locking ring 6. Thus, the latter is housed in said groove, preventing any relative movement in the axial direction of the watch, but which permits the relative rotation between bezel and back on the one hand and the locking ring on the other.

To prevent body 1, 2, 5 rotating freely with respect to ring 6, a locking device is provided between the lower cylindrical portion 22 and the bezel 2 (cf FIG. 3) and the inner surface 61 of ring 6. This device comprises two bosses 13, disposed in a diametrically opposite manner on said surface 61 and 24 slots 14 regularly disposed along the periphery of cylindrical portion 22, whereby two of these slots 14 cooperate with the bosses 13. To rotate body 1, 2, 5 relative to the ring, it is necessary to utilise the elasticity of the material used for the bezel 2 and the ring 6, which permits a rotation under friction (between bosses 13 and the wall of the cylindrical portion 22) until two other slots come into contact with the bosses, thus locking the body in its new position. There are 24 slots so that the body can be rotated hour by hour to correspond with the time zones which, with due exceptions, always differ by full hours.

Whitegold has proved highly satisfactory as the material which ensures the requisite elasticity without being too flexible and without being subject to too great wear caused by friction between the bezel and the ring during rotation. However, other materials can be used, provided that they meet the above-mentioned requirements.

Obviously, the bosses 13 could also be provided on the cylindrical portion 22 and the slots 14 on the locking ring 6.

As can be gathered from FIG. 1, the upper attachment carries e.g. a roman numeral 16 and the locking ring 6 a mark 17 in the form of a coloured dot, a cavity, a relief or any other suitable configuration, said mark determining the extent of rotation with respect to numeral 16 and consequently the fixed part of the watch.

Back 5 is provided with a recess or cutout 18 in order to receive the ring flange 19 (FIGS. 1 and 2). In the same way bezel 2 is provided with a cutout 23 which envelopes the upper part of ring flange 19. To enable the ring flange 19 to come into operation it projects downwards, i.e. with respect to the back 5.

It is very easy to use the watch for determining the time in the different time zones.

If it is desired to know the present time in a particular time zone and the time difference relative to the local time zone is known, for example 5 hours behind, body 1, 2, 5 is rotated and with it the face and hand in the counterclockwise direction until the mark 17 is 5 hours from the fixed numeral 16. It should be noted that the face carries no numeral and that the particular time is determined solely by the position of the hand as is the case with normal modern watches which no longer display numerals. Hand 9, which according to FIG. 1 indicates the local time of about 0115 hours (or 1315 hours) now points obliquely to the left and bearing in mind this known position and by means of the marks 31 on face 3 it is readily apparent that the local time in the said distant time zone is at present approximately 2015 (or 0815 hours). However, on moving to a time zone which is for example ahead the watch is firstly set by rotating the body in the clockwise direction until the hand 9 more or less corresponds with the clocks in the new time zone (the precise position of the hand can then be obtained by actuating the ring flange 19). It is then merely necessary to count the difference in hours between mark 17 and numeral 16 in order to know how many hours this new time zone is ahead of the original zone.

The watch shown is particularly suitable with a view to successive introduction of the summer time into certain countries, which creates a certain confusion as regards to the local time from one country to the next on crossing a frontier.

As is apparent from what has been stated hereinbefore, the world watch shown has no internal part which has to be adjusted from the outside (as is the case with the prior art) with the exception of the hand which must be adjusted from the outside as all watches. Thus, the sealing problems are the same as in conventional watches and can be solved in the same way, without additional difficulties.

Claims

1. A world watch comprising:

a pair of spaced means for attaching straps;

a locking ring disposed between said pair of attaching means and fixedly secured thereto;

a watch case including a watch movement, a watch face, a watch hand driven by said watch movement for indication of time and a bezel disposed about said watch face and fixedly secured to said case, said watch case rotatable secured to said locking ring;

means for locking said watch case in a selected one of a plurality of rotational positions with respect to said locking ring, the length of the arc between each adjacent pair of said rotational positions corresponding to a time difference of one hour;

a reference numeral disposed on one of said attaching means; and a reference mark disposed on said bezel, the number of rotational positions between the location of said reference numeral and the location of said reference mark indicating the time difference in hours between two selected time zones.

2. A watch according to claim 1 wherein said locking means comprises:

a plurality of slots formed on said bezel; and a plurality of bosses formed on said locking ring adapted to mate with said bosses.

3. A watch according to claim 1 or 2 wherein said bezel and said locking ring are formed of a hard material capable of elastic deformation.

4. A watch according to claim 3 wherein said hard material comprises white gold.

* * * * *